US006408904B1

(12) United States Patent
Dushman

(10) Patent No.: US 6,408,904 B1
(45) Date of Patent: Jun. 25, 2002

(54) HYGIENIC BOTTLE CAP

(75) Inventor: Lawrence M. Dushman, Peach Tree City, GA (US)

(73) Assignee: Abel Unlimited, Inc., West Palm Beach, FL (US)

( * ) Notice: Subject to any disclaimer, the term of this patent is extended or adjusted under 35 U.S.C. 154(b) by 0 days.

(21) Appl. No.: 09/834,594

(22) Filed: Apr. 13, 2001

Related U.S. Application Data

(63) Continuation-in-part of application No. 09/421,026, filed on Oct. 20, 1999, now abandoned.
(60) Provisional application No. 60/104,893, filed on Oct. 20, 1998.

(51) Int. Cl.[7] ..... B67D 5/00

(52) U.S. Cl. ..... 141/352; 141/354; 141/364

(58) Field of Search ..... 141/351–354, 141/364

(56) References Cited

U.S. PATENT DOCUMENTS

| | | | | |
|---|---|---|---|---|
| 1,142,210 | A | 6/1915 | Wagner | |
| 1,248,705 | A | 12/1917 | Pogue | |
| 2,213,465 | A | 9/1940 | Gay | |
| 3,392,860 | A | 7/1968 | Faulstich | |
| 3,938,520 | A | 2/1976 | Scislowicz et al. | |
| 3,979,002 | A | 9/1976 | Faulstich | |
| 4,022,258 | A | 5/1977 | Steidley | |
| 4,093,096 | A | 6/1978 | Augros | |
| 4,143,789 | A | 3/1979 | Wade | |
| 4,173,858 | A | * 11/1979 | Cassia | 53/471 |
| 4,221,291 | A | 9/1980 | Hunt | 222/83 |
| D264,942 | S | 6/1982 | Schieser et al. | |
| 4,354,609 | A | 10/1982 | Hidding | |
| 4,364,483 | A | 12/1982 | Golde | |
| 4,393,909 | A | 7/1983 | Pearson | |
| D270,136 | S | 8/1983 | Cox | |
| D270,616 | S | 9/1983 | Cox | |
| D272,604 | S | 2/1984 | Cox | |
| 4,460,100 | A | 7/1984 | Libit | |
| 4,461,394 | A | 7/1984 | Sendel et al. | |
| D276,592 | S | 12/1984 | Cox | |
| 4,488,655 | A | 12/1984 | Itsubo et al. | |
| 4,527,704 | A | 7/1985 | Swartzbaugh | |
| 4,527,706 | A | 7/1985 | Swartzbaugh et al. | |
| 4,597,423 | A | 7/1986 | Chenot | |
| 4,658,977 | A | 4/1987 | Crisci | |
| 4,699,188 | A | 10/1987 | Baker et al. | |
| 4,717,051 | A | 1/1988 | Leclerc | |
| 4,736,859 | A | 4/1988 | Mayes et al. | |
| 4,784,299 | A | 11/1988 | Stenger | 222/87 |
| 4,846,236 | A | 7/1989 | Deruntz | |
| 4,874,023 | A | 10/1989 | Ulm | |
| 4,946,055 | A | 8/1990 | Towns et al. | |
| 4,948,003 | A | 8/1990 | Munoz | |
| 4,953,729 | A | 9/1990 | Kloosterhouse | |
| 4,982,875 | A | 1/1991 | Pozzi et al. | 222/83 |

(List continued on next page.)

FOREIGN PATENT DOCUMENTS

| | | |
|---|---|---|
| EP | 0 118 267 | 10/1986 |
| WO | WO 90/03919 | 4/1990 |

*Primary Examiner*—J. Casimer Jacyna
(74) *Attorney, Agent, or Firm*—Salter & Michaelson

(57) ABSTRACT

A hygienic bottle cap for connection to a fluid container includes a skirt and a crown portion having a cylindrical wall with an upper portion and a lower portion and forms a central well. A flapper forming a portion of the bottom surface of the center well is attached to the cylindrical wall. A score line is formed partially around the perimeter of the flapper between the flapper and the cylindrical wall, and the portion of the perimeter that is not scored remains intact upon insertion of a probe. The flapper may be separated from the cylindrical wall by the probe, and may return to its initial sealed position after the probe is retracted. In one embodiment, a protrusion is supported on an underside of the flapper in order to facilitate separation of the flapper from the cylindrical wall along the score line.

17 Claims, 18 Drawing Sheets

U.S. PATENT DOCUMENTS

| | | | | |
|---|---|---|---|---|
| 4,991,635 | A | | 2/1991 | Ulm |
| 5,048,723 | A | | 9/1991 | Seymour |
| D326,051 | S | | 5/1992 | Frahm |
| D326,608 | S | | 6/1992 | Frahm |
| 5,121,778 | A | | 6/1992 | Baker et al. |
| 5,123,555 | A | | 6/1992 | Luch et al. |
| 5,188,628 | A | | 2/1993 | Rani et al. |
| 5,202,093 | A | | 4/1993 | Cloyd |
| 5,203,838 | A | | 4/1993 | Schneider |
| 5,232,125 | A | | 8/1993 | Adams |
| D339,067 | S | | 9/1993 | Rokus |
| 5,289,855 | A | | 3/1994 | Baker et al. |
| 5,295,519 | A | | 3/1994 | Baker et al. |
| 5,297,599 | A | | 3/1994 | Bucheli |
| 5,363,890 | A | | 11/1994 | Yeung et al. |
| D355,367 | S | | 2/1995 | Rokus |
| 5,392,939 | A | | 2/1995 | Hidding et al. |
| 5,413,152 | A | | 5/1995 | Burrows |
| D361,039 | S | | 8/1995 | Rokus |
| D361,720 | S | | 8/1995 | Rokus et al. |
| 5,456,294 | A | | 10/1995 | Tsao et al. |
| 5,472,021 | A | | 12/1995 | Tsao et al. |
| 5,573,047 | A | | 11/1996 | Akin |
| 5,653,270 | A | | 8/1997 | Burrows |
| 5,687,865 | A | | 11/1997 | Adams et al. ..... 215/253 |
| 5,687,867 | A | * | 11/1997 | Lamoureux ..... 215/303 |
| 5,711,420 | A | | 1/1998 | Spring |
| 5,730,334 | A | | 3/1998 | Mizrahi |

* cited by examiner

HYGIENIC BOTTLE CAP

RELATED APPLICATIONS

This application is a continuation-in-part under 35 U.S.C. §120 to U.S. application Ser. No. 09/421,026 filed on Oct. 20, 1999, now abandoned, which claims priority to U.S. application Ser. No. 60/104,893 filed on Oct. 20, 1998.

TECHNICAL FIELD

The invention relates generally to a system for dispensing water and, more particularly, to a bottle cap which allows a bottle to be readily mated with a dispenser while substantially preventing debris from entering the water supply upon loading of a bottle onto the dispensing system.

Background of Related Art

Hygienic liquid dispensing systems for selectively dispensing a liquid, such as water, are well known in the art. Such systems generally include a container which holds the liquid to be dispensed, the container typically being a bottle having a neck with an opening for dispensing the water therethrough. The bottle may be loaded or mounted into a re-usable dispenser by lifting and inverting the bottle and placing the neck into a receptacle in the dispenser, which is adapted to hold the bottle in the inverted position. The water may then be discharged through an aperture, a tube, or other passageway formed in the receptacle, and into a chamber in the dispenser. A user may then draw water from the chamber through a stop valve, as desired.

Prior art bottles have utilized a cap for sealing the opening of the bottle in order to prevent spillage of the water as it is being inverted and mounted into the dispenser. A probe may be provided in the water dispenser to pierce the cap when the water bottle is mounted to the water dispenser to enable water to flow from the bottle to the chamber of the dispenser. Filtered air may be provided to the chamber through a filtered air system to enable water to be drawn from the chamber when the dispensing system is being used.

Such prior art liquid dispensers often include a sharp probe with a pointed end which is used to puncture a cap on the liquid container when the container is placed in the dispenser. This type of probe is described in the aforementioned '188 patent. Such a sharpened probe is also utilized in U.S. Pat. No. 5,048,723 and is used to pierce the cap disclosed therein. In use, the water bottle having a cap disposed over the neck is inverted and placed on the water dispenser such that the sharp probe contacts and impales the cap, thereby creating an opening in the cap through which water flows, from the bottle and into the chamber of the water dispenser. While such dispensers utilizing a sharpened probe are generally effective, the sharpness of the probe can result in injuries when a hand or fingers of a person contact the sharp probe area during cleaning or positioning the water bottle. In addition, after the sharpened point of the probe has penetrated the bottle cap, if the water bottle is thereafter removed form the water dispenser when there is water remaining in the bottle, water may exit the bottle via the opening created by the probe and spill onto the outside of the water dispenser and/or the floor.

Rather than relying on a pointed probe to impale a bottle cap, some prior art water dispensing systems have employed alternative techniques for breaking a seal of a bottle cap when the water bottle is inverted and installed on the water dispenser. For example, U.S. Pat. No. 5,232,125 discloses a bottle cap having a removable plug inserted therein to seal the water bottle. In the system disclosed in this reference, when a blunt probe is inserted into the end of the bottle cap, the plug becomes lodged on the end of the probe and is pushed into the water bottle along with the probe. When the probe is then removed from the bottle cap, the plug is reseated into the end of the bottle cap so that the water bottle is again sealed. With this type of bottle cap, there is a risk that the removable plug may become dislodged from the end of the probe when the probe is inserted in the water bottle. Thus, water may spill onto the outside of the water dispenser and/or the floor when the water bottle is removed from the water dispenser with water remaining in the water bottle. In addition, the requirement that a specialized plug be included in each bottle cap can significantly increase the manufacturing cost of these types of bottle caps.

Other prior art bottle caps that are designed for use with blunt-ended probes are disclosed in U.S. Pat. Nos. 5,687,867 and 5,687,865. The bottle caps disclosed in these patents include conical surfaces which are scored along one or more meridian planes thereof to enable the ends of blunt probes to penetrate them. In U.S. Pat. No. 5,687,865, a single frangible line 51 extends through a meridian plane of the to-be-penetrated cone so that when the tip 62 of a blunt probe is pressed against an inner surface of the cone, the cone splits into two halves as the probe enters the water bottle through the slit formed between the two halves. The '865 patent discloses that a rib 56, perpendicular to the plane of the score line 51 is centrally disposed on the exterior of the bottom 53 of the cone, as shown in FIG. 2. The rib is first engaged by the probe in order to aid in splitting the cone. The two halves of the cone are preferably made of a resilient plastic material that causes the cone to return substantially to its original shape, thereby inhibiting water from exiting the water bottle if the water bottle (with water remaining therein) is removed from the water dispenser. However, because the shape memory of the plastic material forming the cone is imperfect (i.e. some permanent deformation will necessarily occur in response to the cone being penetrated by the probe, especially when the probe remains in the cone for an extended period of time), the cone will not return completely to its pre-penetrated shape and some sort of gap will generally be left between the two halves of the cone after the probe is removed. This fact is pointed out in the written description of the '865 patent (see for example, Col. 5, lines 5–8). Therefore, some water will be permitted to leak from the gap when a water bottle having water remaining therein is removed from the water dispenser.

In U.S. Pat. No. 5,687,867, frangible lines extend through multiple meridian planes of the to-be-penetrated cone so that, when a blunt probe 70 is pressed against an inner surface of the cone, the cone is caused to fragment into several petal-shaped segments as the probe 70 enters the water bottle 12 via the bottle cap 10. An injection stem 42 (formed by the injection molding process) may be attached by a thickened connection line 44 to one of the petal-shaped segments 40. FIG. 2 illustrates the probe 70 engaging the injection stem 42 as it penetrates the cone. The injection stem is connected centrally, at the apex of the cone, and is apparently hinged by the connection line to the end of only one peal-shaped segment after engagement by the probe. When the probe 70 is removed from this type of cone, the petals of the cone do not return to their original, non-penetrated position. Therefore, an opening of some size remains between the petals-shaped segments of the cone after the probe 70 is removed from within the bottle cap 10.

Other techniques for enabling a water bottle to be installed on a water dispenser are disclosed in U.S. Pat. Nos.

5,456,294 and 5,472,021. In each of these patents, a specialized structure is used to create an opening in a bottle cap in response to the creation of a hydraulic shock wave within the water bottle, e.g., when a person physically strikes the sides of the bottle. Using these techniques, however, it is possible that the bottle cap may prematurely permit water to exit the bottle if a physical force is exerted on the water bottle before it is properly installed on the water dispenser. Additionally, if water bottles employing these bottle caps are removed from the water dispenser before the water bottle is emptied completely, water may spill onto the outside of the water dispenser and/or the floor.

Still further techniques for enabling a water bottle to be installed on a water dispenser are disclosed in U.S. Pat. No. 5,363,890. Disclosed in this patent are techniques which delay the time taken for water to exit the water bottle after the water bottle is inverted for installation on a water dispenser. Specifically, this reference teaches that a membrane seal in the bottle cap which is folded multiple times can be caused to gradually unfold in response to water pressure being exerted thereon when the water bottle is inverted for installation. It also teaches that, alternatively, a water sensitive material can be employed in the bottle cap to gradually enable water to exit the water bottle as the material reacts to water that comes into contact therewith when the water bottle is inverted for installation. As with the techniques described above requiring hydraulic shock waves to activate opening of the bottle cap, there is a risk that water will exit the water bottle prematurely, i.e., before the water bottle is properly mounted on the water dispenser. For example, this may occur if the water bottle is inverted during storage or if an excessive period of time elapses between when the user inverts the water bottle and when the user actually installs the water bottle on the water dispenser. Further, if water bottles employing these bottle caps are removed from a water dispenser before the water bottle is emptied completely, water may spill onto the outside of the water dispenser and/or the floor.

Thus, there is a need for a hygienic bottle cap which reduces the amount of spillage that occurs when utilizing a removable bottle with a dispenser, and which does not require a large amount of force to pierce the bottle's cap so that a blunt probe in the dispenser may be used.

SUMMARY

One object of the present invention is to provide a hygienic bottle cap for a fluid container which can be readily mated with a dispenser, while preventing unwanted debris from entering the fluid supply upon loading of the container onto the dispensing system.

In one embodiment, a hygienic bottle cap for connection to a fluid container has a skirt and a crown portion, and includes a cylindrical wall having an upper portion and a lower portion and forming a central well in the crown portion of the cap. A flapper forming a portion of the bottom surface of the central well is attached to the cylindrical wall and a pre-formed score line is formed partially around the perimeter of the flapper such that a blunt-tip probe may enter the container by applying a force to the flapper sufficient to separate a portion of the flapper from the cylindrical wall along the pre-formed score line. The flapper may be connected to the cylindrical wall with two separate tab portions.

In another embodiment, the flapper may be attached to the cylindrical wall with a bridge connected to the flapper. The flapper may be constructed of a material to allow the flapper to return to its original sealed position after a probe which has separated the flapper has been removed from the central well. In another embodiment, the flapper may form the entire bottom surface of the central well such that a sealing shelf may be formed with the cylindrical wall.

In yet another embodiment, the flapper may include a protrusion supported on an underside of the flapper. The protrusion is designed to be engaged by the probe in order to concentrate the force of the probe and break the flapper at a pre-determined location, for example along the pre-formed score line.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

This invention relates to an improved bottle cap adapted to be penetrated by a blunt probe for use with a standard water bottle (for example a 5 gallon capacity) or other similar fluid container which is utilized with a dispenser. One exemplary dispenser for use with the invention is disclosed in U.S. Pat. No. 4,699,188, entitled HYGIENIC LIQUID DISPENSING SYSTEM, the content of which is hereby incorporated by reference. An exemplary probe for use in connection with the present invention is disclosed in U.S. Pat. No. 5,232,125, entitled NON-SPILL BOTTLE CAP USED WITH WATER DISPENSERS, the content of which is hereby incorporated by reference.

Figure 3:
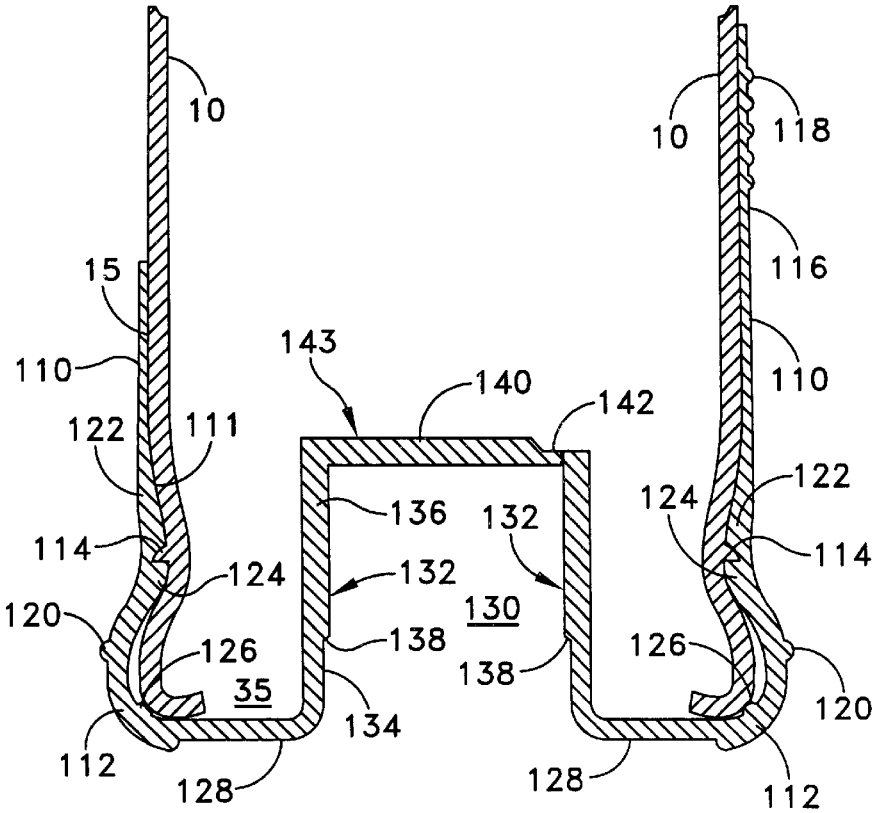
FIG. 3 is a cross-sectional view of the bottle cap of FIG. 2 taken along line 3—3 of FIG. 2 and along line 5—5 of FIGS. 4A, 4B.

The improved cap 100, illustrated in more detail in FIG. 3, is disposed over the outer circumference or surface 15 of the bottle neck 13, and includes a central well 130 which is received within the neck of the bottle, the opening 131 of the well being sealed by a flapper 140 in a closed position when the bottle is not dispensing water. A pre-formed frangible path or score line 142 defines the flapper which is formed when the preformed score line is broken by a blunt tip probe 18 entering the well 130 and engaging the base 143 of the well. The score line is partially disposed around the base such that the flapper remains at least partially attached to the base after being penetrated by the probe. In this manner, when the probe is later removed from within the well of the cap, the flapper is caused to close so that water remaining in the bottle is substantially prevented from leaking through the opening defined by the flapper, as described in greater detail below.

Figure 2:
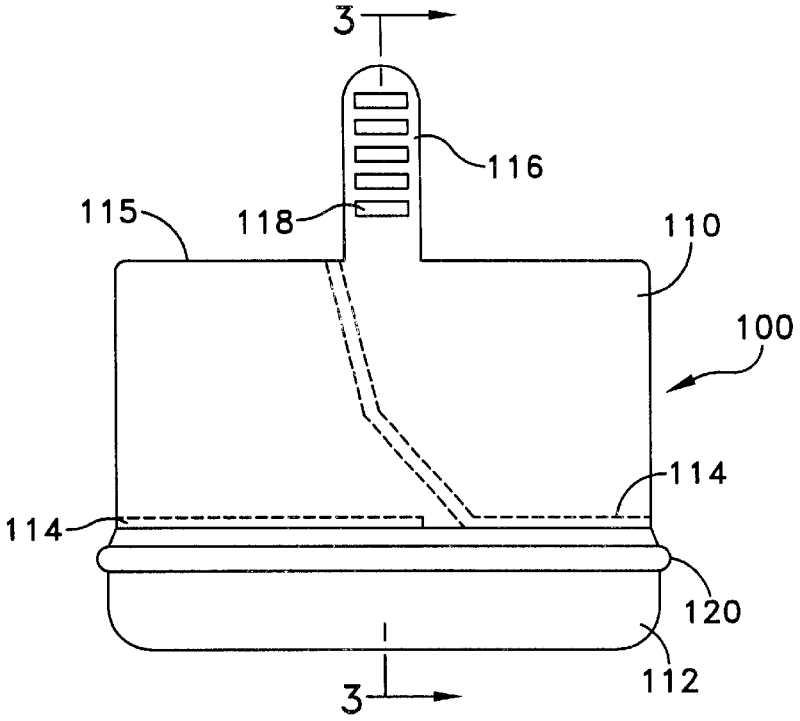
FIG. 2 is a side view of a bottle cap according to one embodiment of the present invention.

As shown in FIG. 2, the cap 100 may further include a skirt 110 and a crown 112, the central well 130 being disposed in the crown of the cap and defined by a cylindrical wall 132 as described in greater detail below. A second frangible path or score line 114 is preferably formed between the skirt 110 and the crown 112 to enable the skirt 110 to be selectively torn from the crown 112, as is known in the art. The score line 114 also preferably extends from the crown to a distal edge 115 of the skirt. A pull tab 116 with several grip lines 118 may be attached to the skirt 110 at the distal edge 115 near the score line 114 to facilitate tearing of the skirt from the crown. By pulling on the pull tab 116, the user can cause the skirt 110 to tear along the score line 114 from the distal edge 115 of the skirt 110 to the crown 112 of the skirt 110, and then substantially around a perimeter of the crown 112. After the skirt 110 has been removed in this manner, the cap can be readily removed from the bottle 10 for use with water dispensers 12 that are not equipped with probes 18. A ridge 120 may also be provided on the crown to enable the user to grasp the cap 100 more easily when lifting the bottle 10.

The inside surface 11 of the cap 100 is designed to mate with the outer surface 15 of the neck of the bottle and form a seal therewith. Specifically, as shown in FIG. 3, the inside surface is provided with a thickened portion 122 to mate with an area of reduced circumference of the bottle 10 and to provide strength to the skirt near the score line. A second thickened portion 124 may also be provided on an inside surface of the crown 112 to mate with a corresponding sloped surface on the neck of the bottle 10. The second thickened portion 124 may be slid under a crown of the bottle 10 to pull the cap 100 onto the neck 13 of the bottle 10. The second thickened portion may also provide a secondary seal between the cap 100 and the neck of the bottle 10 to prevent water from leaking out and/or to prevent contaminants from entering the bottle 10.

A primary seal between the cap 100 and the neck 13 of the bottle 10 may also be provided by an annular ridge 126. The annular ridge 126 of the cap 100 may physically contact the bottle along its entire circumference of the neck, thereby forming a hermetic seal between the inner surface 111 of the cap and the outer surface 15 of the neck of the bottle. More than one ridge 126 may be provided, if desired. The ridge 126 may preferably be deformable so that while seating the cap 100 on the bottle 10 a more secure seal is formed.

As shown in FIG. 3, cap 100 may also preferably include an annular indented region 128, formed on the outside surface of the cap 100. In the present embodiment, the indented region 128 is formed around the central well 130 of the cap. An adhesive label (not shown) may be secured on annular indented region and over the central well, to maintain the central well 130 free of dust and other debris. Optionally, the label may be printed with identifying information to enable the source of the water to be identified readily. In an alternate embodiment, the cap 100 may have a flush outside surface without the annular indented region 129 (see FIG. 10).

Referring now to FIGS. 3 and 4, the central well 130 may preferably be defined by cylindrical wall 132 having an upper portion 134 and a lower portion 136. Upper and lower in this context should be viewed from the perspective of the well, the top of the well is adjacent the annular indented region 128 and the bottom of the well is closed by the flapper 140 (discussed in greater detail below). The upper portion 134 of the cylindrical wall 132 may preferably be configured such that its diameter is slightly larger than a diameter of the probe 18. The increased diameter of this upper portion 134 facilitates seating of the probe 18 into the central well 130 when the bottle 10 is placed on the dispenser 12. The lower portion 136 of the cylindrical wall 132 may preferably have a diameter equal to or marginally smaller than the diameter of the probe 18 to ensure a proper seal between the probe 18 and central well 130 of the cap 100 upon insertion of the probe.

The upper portion 134 and the lower portion 136 of the cylindrical wall may be separated by a transition portion 138 formed generally perpendicular to each of the upper and lower portions respectively. Alternatively, the transition portion 138 may be set at an angle other than perpendicular to the upper and lower portions. Optionally, the upper and lower portions may be blended together so that the cylindrical wall 132 has a continuously varying diameter along at least a portion of its length. Likewise, if desired, the cylindrical wall 132 may be formed to have a uniform diameter, approximately equal to the diameter of the probe 18, thereby forming a seal between the inner surface of the cylindrical wall 132 and the outer surface of the probe 18, when the probe is inserted through the well 130.

A described above, the opening 131 of the well which is in communication with the interior of the bottle neck is sealed by a base 143 which includes a flapper 140 formed therein. The flapper 140 is in a closed position when the bottle is not dispensing water. Pre-formed score line 142 defines the configuration of the flapper 140 prior to insertion of the probe. The flapper 140 may be attached to the cylindrical wall 132 at any number of locations thereof so as to form the base of the well. In the present embodiment, the flapper may preferably be attached to the cylindrical wall 132 along the lower portion 136 thereof, and preferably at or near the bottom of the well 130 adjacent opening 131. The flapper 140 is severed from the wall 132 along the score line upon insertion of the probe through the well 130 and into the interior of the bottle 10.

The frangible path or score line 142 defines the flapper 140 in the initial or closed position and enables the flapper 140 to be readily separated from the cylindrical wall 132 upon insertion of the probe 18. The frangible path or score line may be formed in any of numerous ways. It is important only that the frangible path 142 be more fragile than the portions of the bottle cap 142 surrounding it, thereby permitting the flap 140 to be readily separated from the cylindrical wall 132 (or another portion of the bottle cap 100) along the path defined by the score line 142 when the bottle is inverted and contacted by the probe. For example, the frangible path may be a score line, as discussed, or may (for example) be a section of the cap that has been intentionally weakened, either physically or chemically.

The score line preferably extends only about the perimeter of the base 143 of the well 130, and does not preferably extend across the base of the well (for example through the center of the base), as do the frangible lines in some prior art caps as discussed above. This aspect of the invention significantly increases the ability of the flapper 140 to reseal the cap after the probe is removed from the cap 100 (see FIG. 8). In addition, it may be noted that the cylindrical wall 132 of the well 130 is not deformed when the probe 18 is inserted therein. Because the cylindrical wall 132 substantially maintains its shape, the ability of the cylindrical wall to form a hermetic seal with the probe 18 is improved significantly. In particular, in the present embodiment, the seal may be formed between the upper portion of the cylindrical wall 132 and the probe 18, whereas this may not occur using some prior art bottle caps.

Figure 4A:
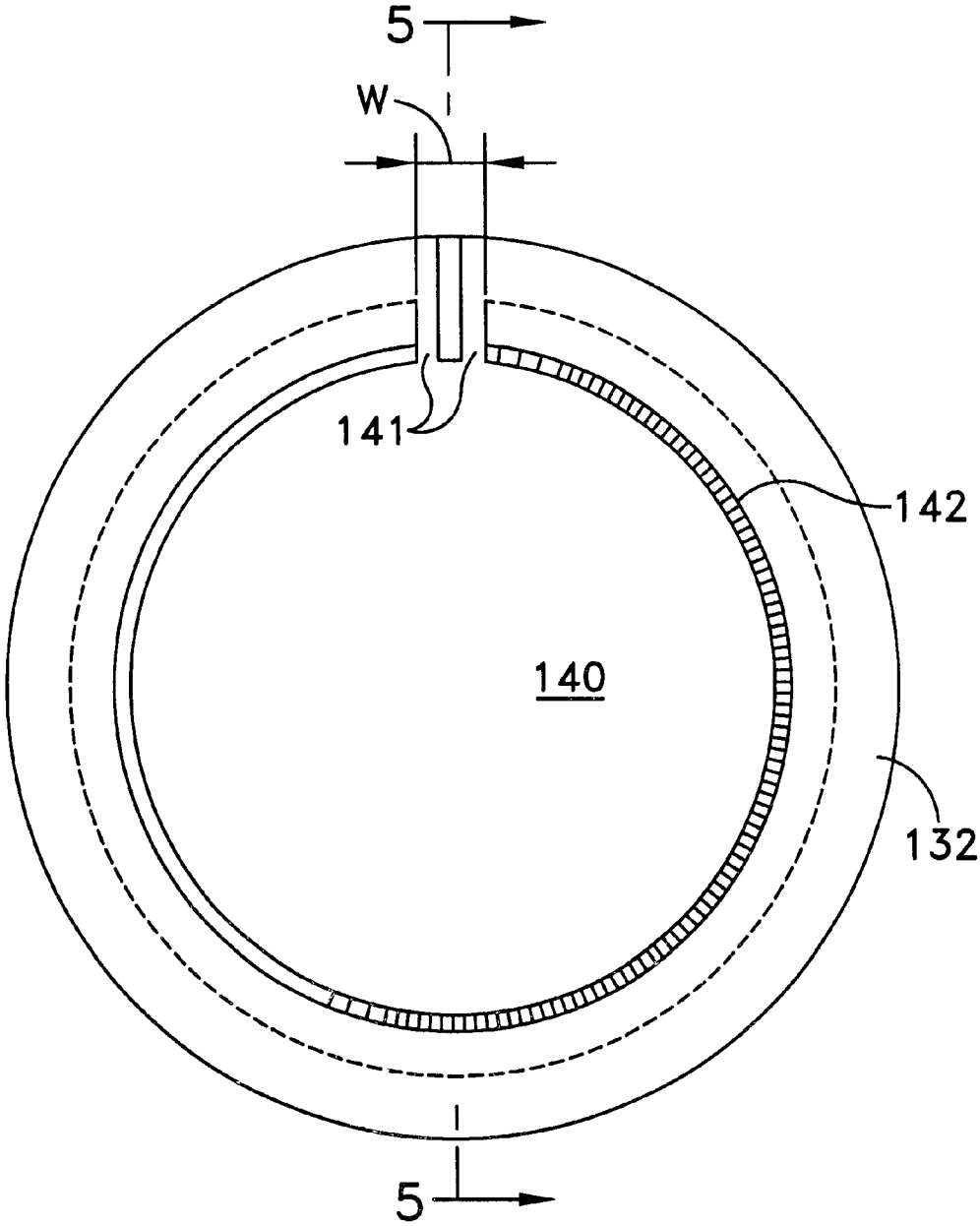
FIG. 4A is a top view in partial cross-section of the cylindrical sidewall and flapper of FIG. 2.
Figure 4B:
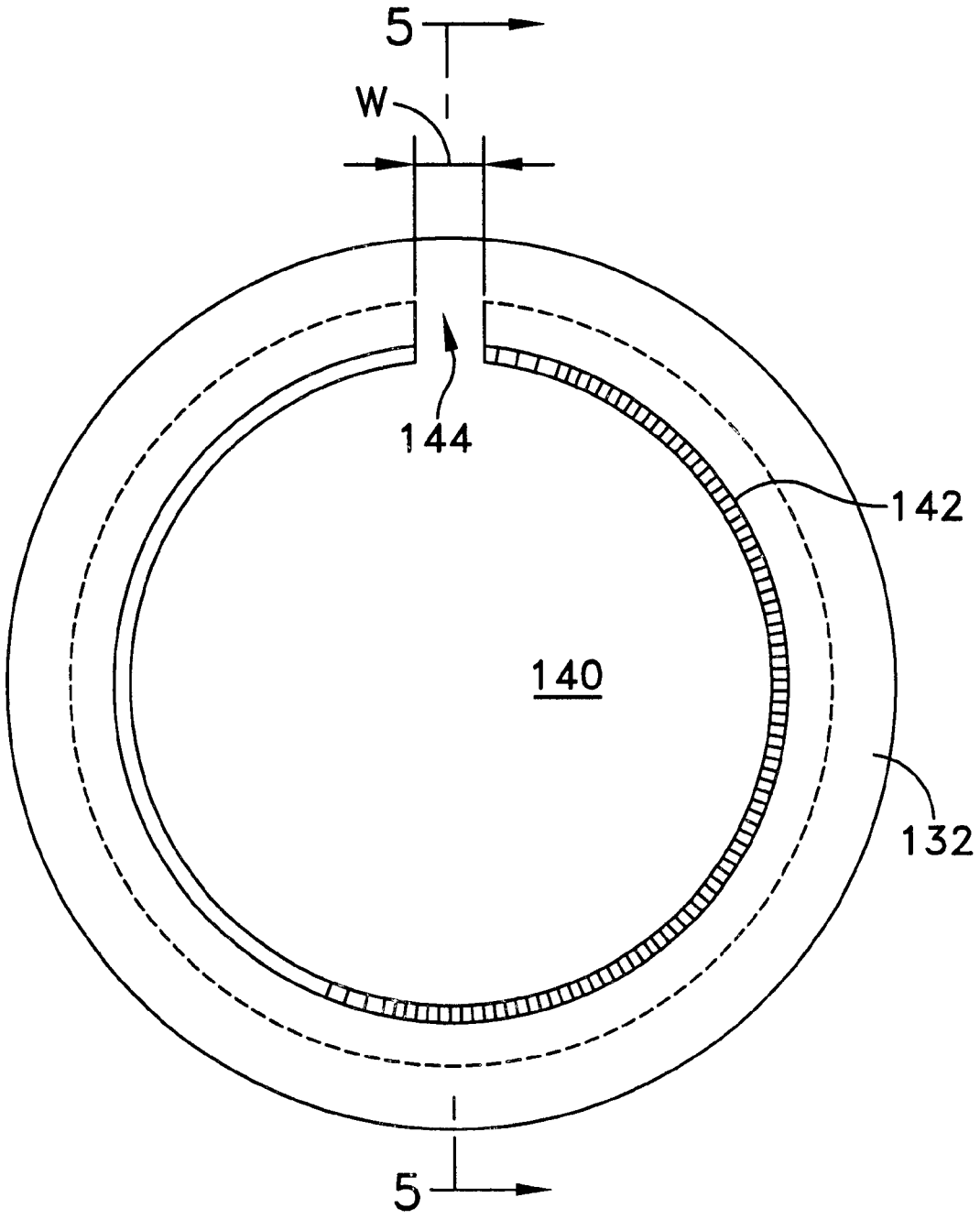
FIG. 4B is a top view in partial cross-section of the cylindrical sidewall and flapper of FIG. 2.

In the present embodiment, the score line 142 preferably does not extend completely around the perimeter of the flapper 140. Instead, as shown in FIG. 4A, a portion of material relatively thicker than the material of the score line 142 may provided as two or more tabs 141 to hinge the flapper 140 to the cylindrical wall 132 during and after insertion of probe 18 into central well 130. Each tab is preferably connected to the flapper and the cylindrical wall and are separated by a space there between. The addition of the one or more spaces between the tabs may increase the flexibility of the attachment of the flapper to the cylindrical wall and improve the functionality of the cap as well. Alternatively, as shown in FIG. 4B, the connection between the flapper 140 and the cylindrical wall 132 may be formed by a single tab, by providing material in the space between tabs 141 to form a bridge 144. In another embodiment, the bridge 144 or tabs 141 may incorporate a true to life hinge. In any case, the flapper should preferably remain connected to the bottle cap after the score line is broken and the probe is inserted so that the flap can swing between a position in which the flapper is within the neck of the bottle and a position wherein the flapper closes the opening in the cap in communication with the interior of the bottle.

Exemplary dimensions of various portions of the cap 100 as they relate to the functionality of the flap will now be described. These dimensions are exemplary only, and may be varied as would be known to those of skill in the art. The score line 142 may be, in an axial direction of the cap, between about 3 to 10 mils thick, preferably about 5 mils thick, and may be, in a radial direction of the cap 100, between 1 to 10 mils wide, preferably about 3 mils wide. The bridge 144 may be between 30 and 180 mils wide, and is preferably about 150 mils wide (W). The tabs 141 may each be about 30 mils wide, and may be separated by a space of about 90 mils. When multiple tabs 141 are employed, the width of the collective width of the tabs is considered to be the sum of the widths of the individual tabs, exclusive of the spaces there between. Thus, in the example given above where the tabs are each 30 mils wide and separated by a space of 90 mils, the total width of the tabs would be 60 mils, rather than 150 mils. The tabs 141 taken together, or the bridge 144 may be the same thickness, thicker or thinner than the flapper 140, although preferably the thickness of the tabs or bridge is between about 20 to 60 mils (about 35 mils in the present embodiment), and the flapper is preferably between about 20 to 60 mils thick (about 35 mils in the present embodiment). Both the tabs 141 and the bridge 144 should be of sufficient width and thickness as compared to the width and thickness of the score line to prevent the flapper 140 from separating from the cylindrical wall 132 upon insertion of the probe 18. To permit the flap to swing into and out of the interior of the neck of the bottle, the ratio of the perimeter of the flap to the width of the bridge or tabs may preferably be greater than about four to one, greater than ten to one, or even greater than forty to one.

Figure 5:
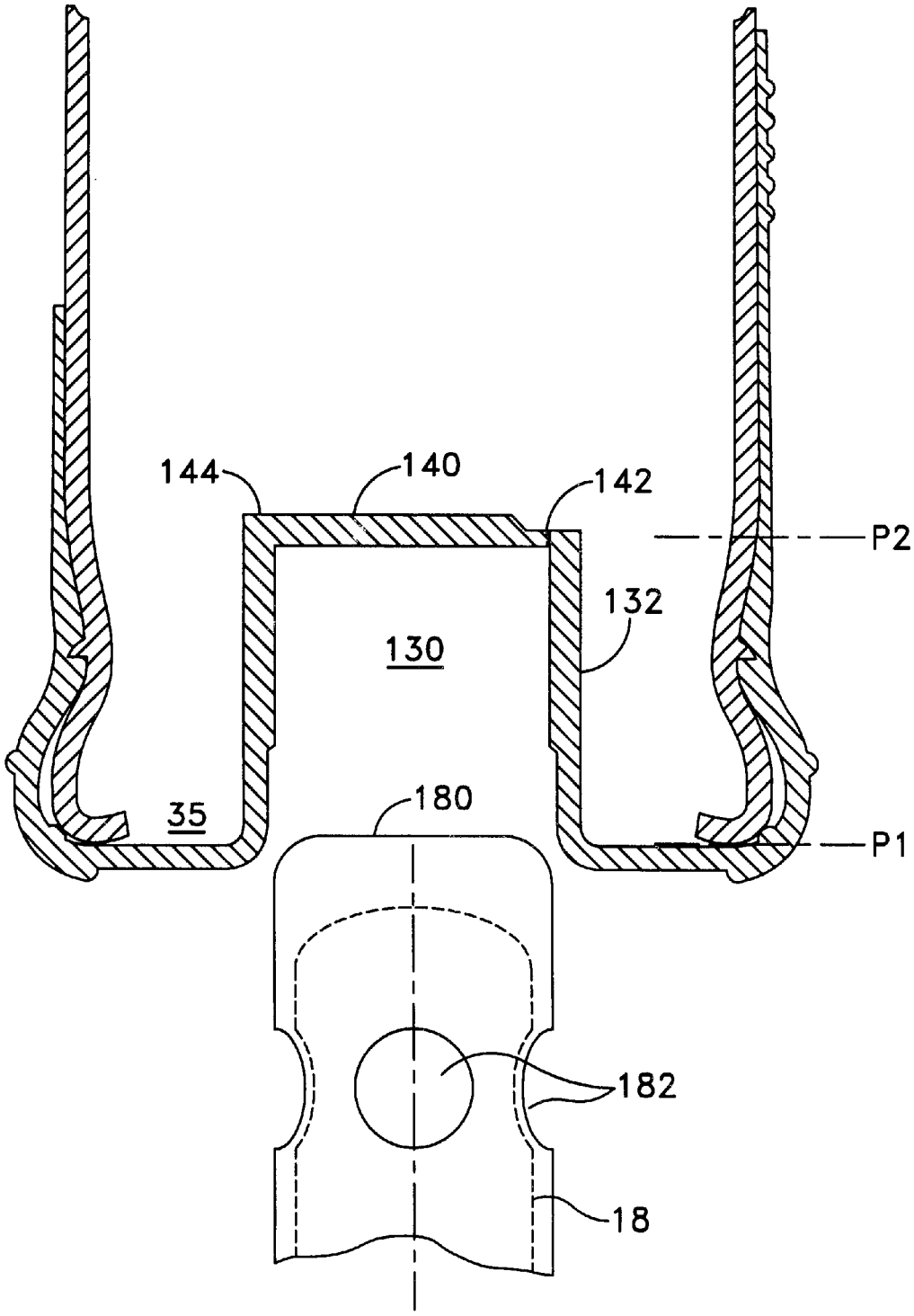
FIG. 5 is a cross-sectional view of the bottle cap of FIG. 2 taken along line 3—3 of FIG. 2 and along line 5—5 of FIGS. 4A, 4B prior to insertion of a probe.
Figure 6:
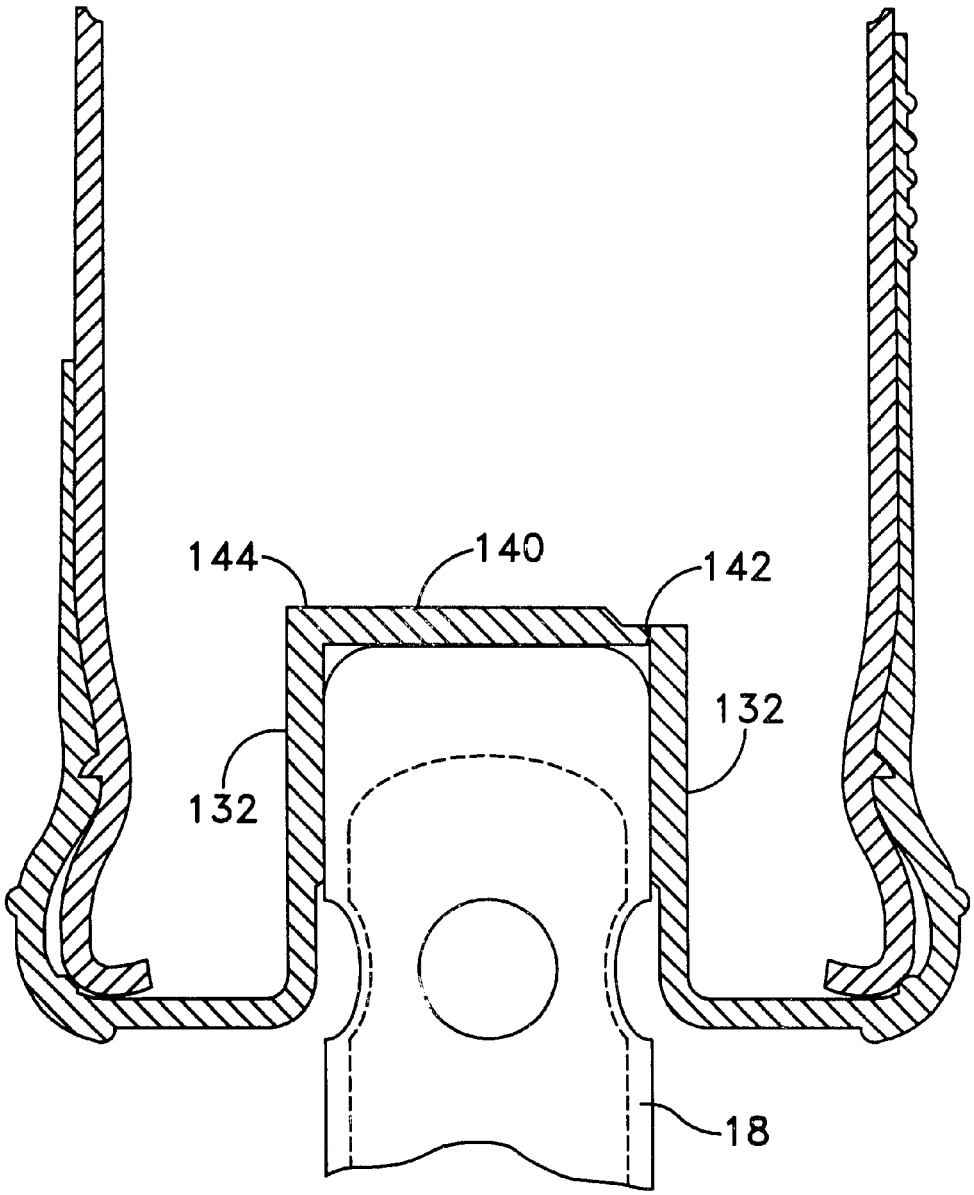
FIG. 6 is a cross-sectional view of the bottle cap of FIG. 2 taken along line 3—3 of FIG. 2 and along line 5—5 of FIGS. 4A, 4B subsequent to insertion of the probe, but before the probe tears the flapper from the cylindrical sidewall along the score line.
Figure 7:
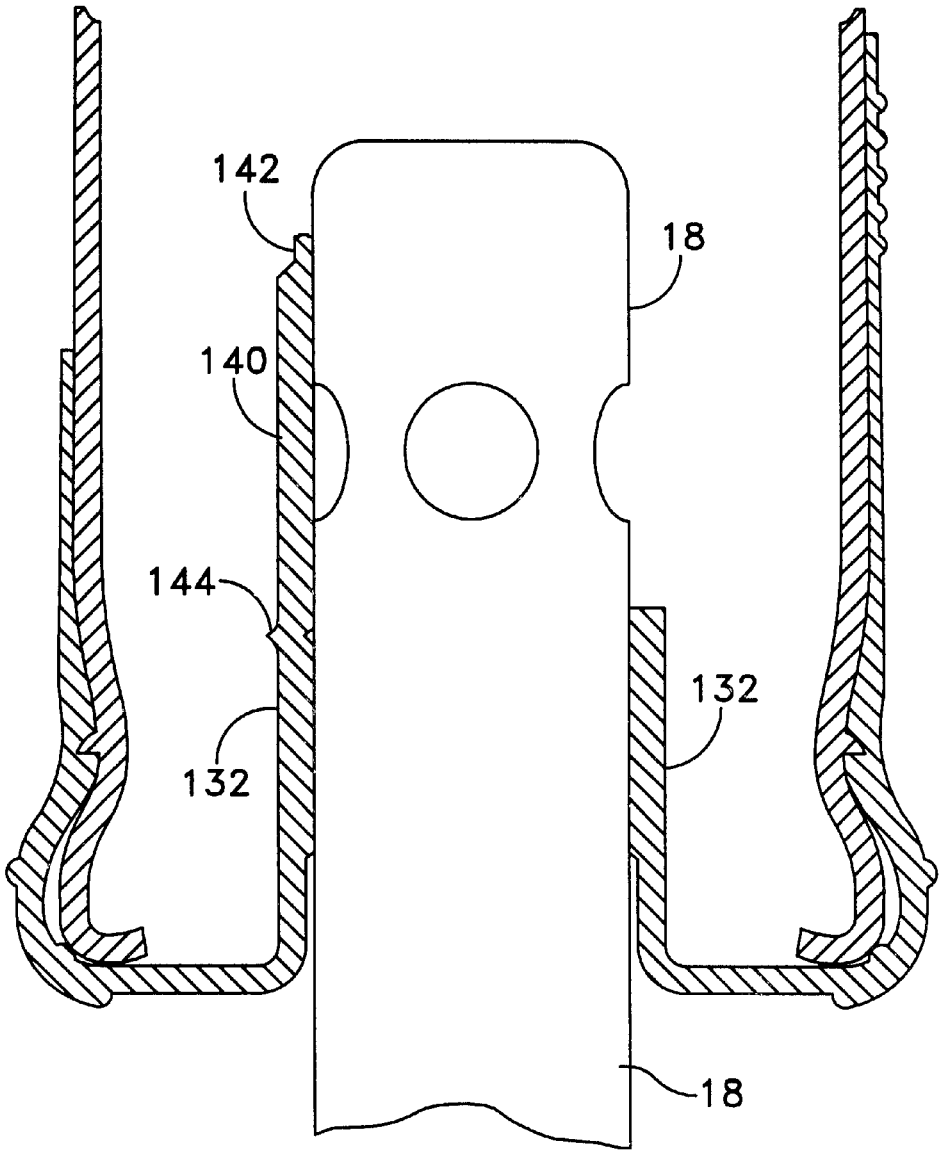
FIG. 7 is a cross-sectional view of the bottle cap of FIG. 2 taken along line 3—3 of FIG. 2 and along line 5—5 of FIGS. 4A, 4B after the flapper has been separated from the cylindrical sidewall along the score line.

As shown in FIG. 5, the opening 35 in the neck of the bottle 10 may be oriented in a first plane, P1, and the cap may substantially cover the opening 35 of the bottle, and may be seated at least partially within the opening in the present embodiment. Advantageously, the score line 14 (and therefore the to-be-formed flapper 140) may be disposed in a second plane P2, which is substantially parallel with P1. Alternatively, the plane P2 may be substantially coincident with the plane P1. This orientation of the score line 142 with respect to the opening 35 may improve the operation of the flapper 140 as described herein.

The bottle cap 100 is preferably configured such that the probe 18 is inserted into through the cap 100 via the well 130 as described herein above. The axis of the probe is preferably substantially perpendicular to the plane P2 in which the score line is disposed (and the flapper in the closed position) as the probe is inserted into the well. This orientation of the score line relative to the probe upon insertion into the cap 100 also helps enable the flapper 140 to operate as described herein.

Figure 9:
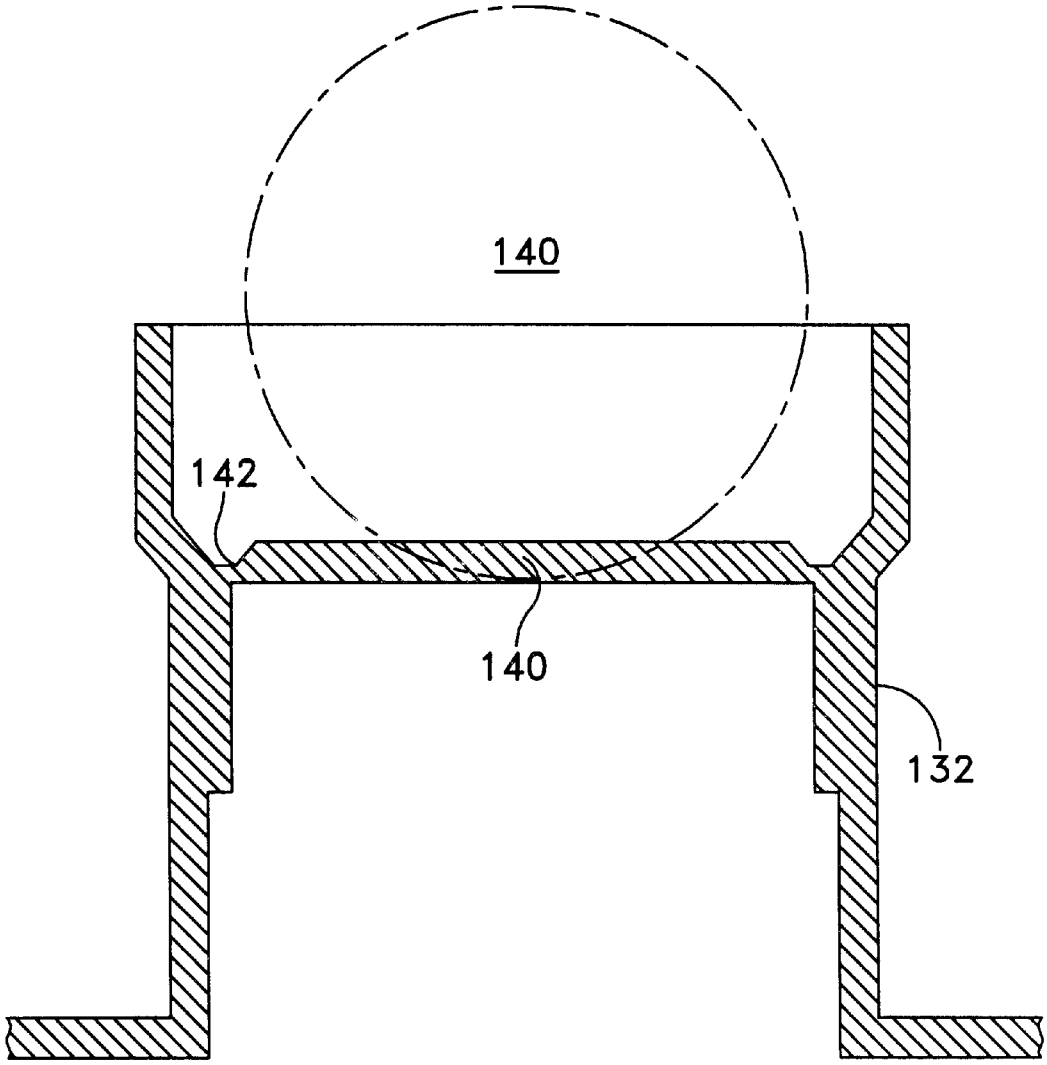
FIG. 9 is a cross-sectional view of the bottle cap of FIG. 2 illustrating the flapper in the closed position and in the open position (dashed lines)
Figure 10:
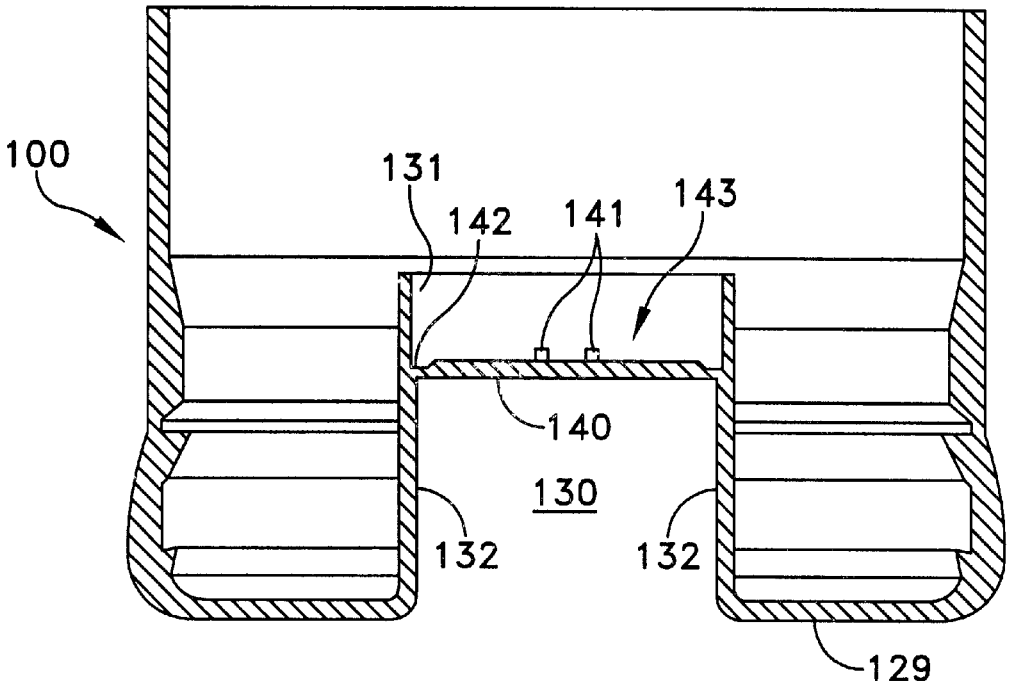
FIG. 10 is a cross-sectional view of a bottle cap similar to FIG. 2.
Figure 11:
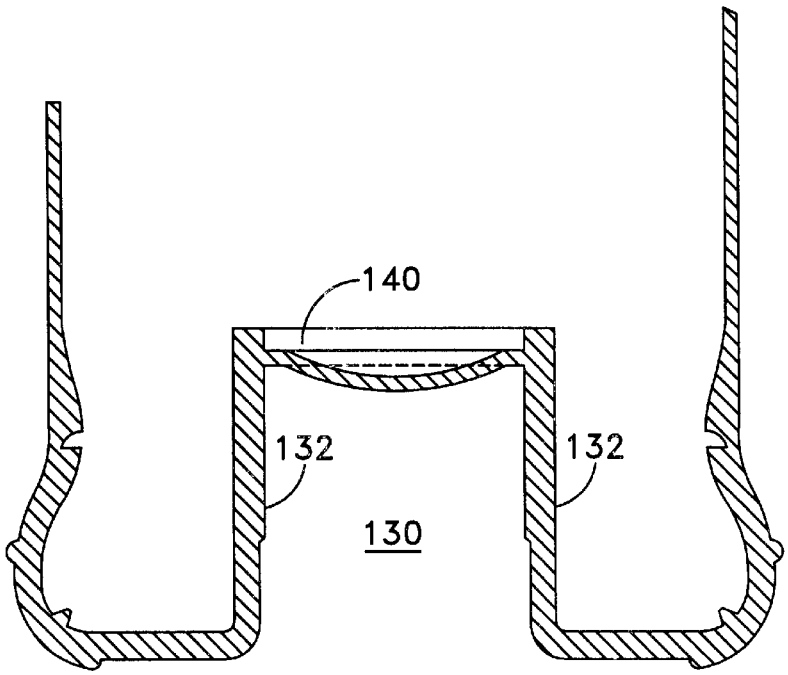
FIG. 11 is a cross-sectional view illustrating an alternative embodiment of the bottle cap according to the present invention.
Figure 12:
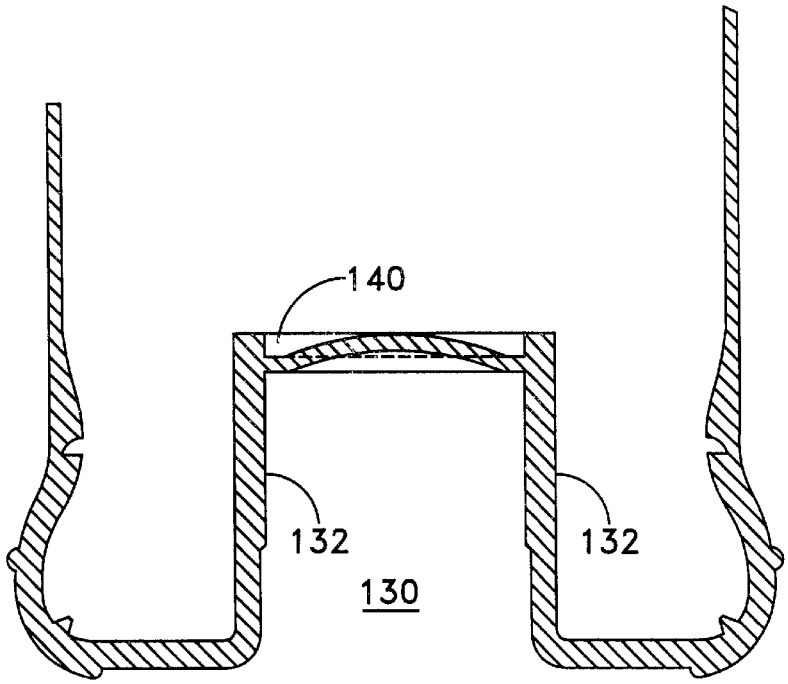
FIG. 12 is a cross-sectional view illustrating another alternative embodiment of the bottle cap according to the present invention
Figure 13:
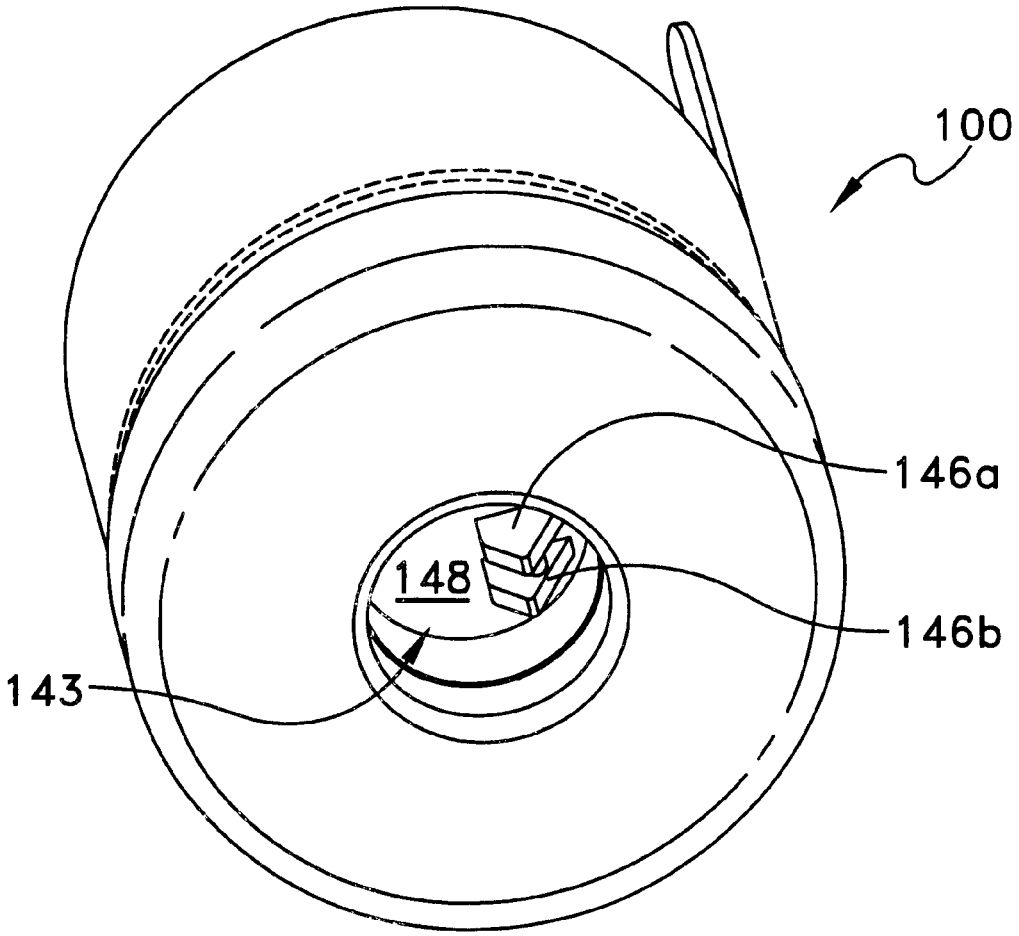
FIG. 13 is a perspective view of a bottle cap according to another embodiment of the present invention.
Figure 14:
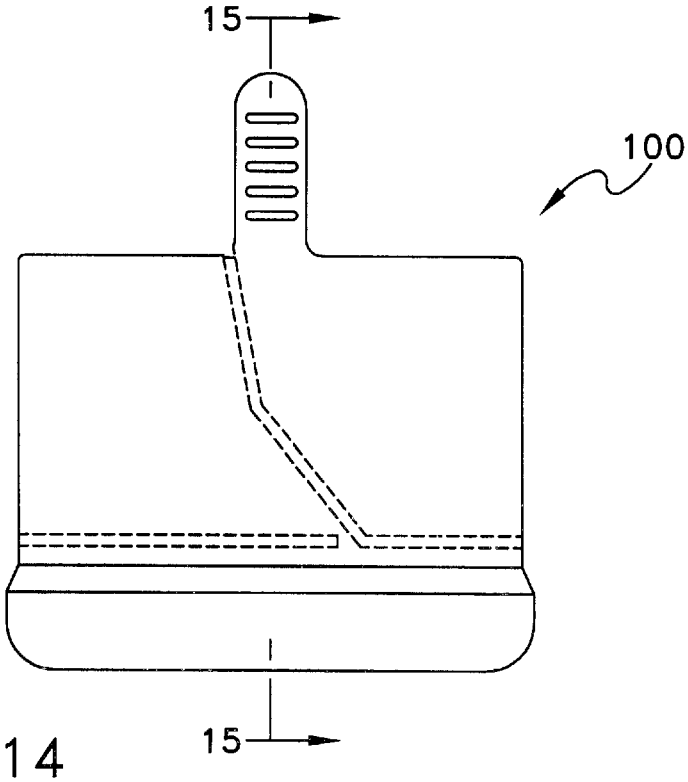
FIG. 14 is a side view of a bottle cap of FIG. 13.
Figure 15:
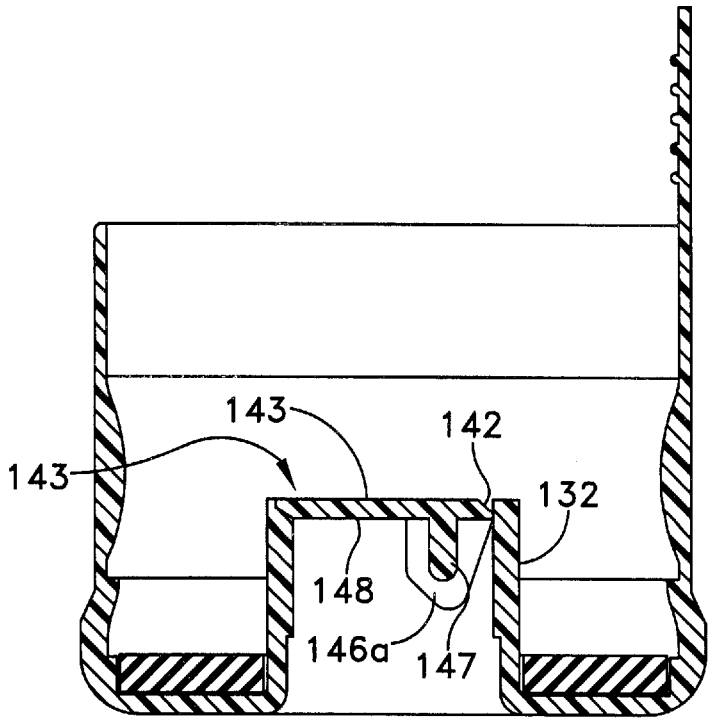
FIG. 15 is a cross-sectional view of the bottle cap of FIG. 13 taken along line 15—15 of FIG. 14 including a flapper protrusion.

Alternative embodiments are illustrated in FIGS. 9, 10, 11, and 12. As shown in FIGS. 9 and 10 the flapper 140 may be joined to the cylindrical sidewall 132 at a location other than at the lowest portion of the cylindrical sidewall 132 adjacent opening 131. As shown in FIGS. 11 and 12, the flapper 140 may be curved inward (FIG. 11) or bowed outward (FIG. 12). In any of the above embodiments, the cylindrical wall 132 may extend beyond the flapper 140 which may reduce the amount of water spilled when the bottle 10 is removed from the water cooler 12. In one embodiment, the cylindrical wall 132 may be extended 200 mils above the flapper 140.

The embodiment of FIG. 10 illustrates the base 143 of the well positioned intermediate the first 145 and second 147 openings in the well such that the cylindrical wall 132 extends beyond the base 143 and into the neck prior to insertion of the probe (not shown). In this embodiment, the tabs 141 are preferably formed on the edge of the cylindrical wall 132 closest to the viewer. The tabs 141 allow the flapper 140 to close more easily when the probe is retracted. The cap 100 is further illustrated without a ridge 120 and with a flush surface, without annular indented region 128. However, it is possible to have flapper 140 connected to cylindrical wall 132 by two tabs 141, with the cylindrical wall 132 ending at the level of the flapper 140, similar to the wall 132 shown in FIG. 3.

In another embodiment, the bridge 144 may incorporate a spring mechanism to force the closure of the flapper valve and to reduce the amount of water which is spilled when the water bottle 10 is removed form the water cooler 12. Likewise, tabs 141 may also incorporate a spring mechanism. To further reduce the amount of spilled water, the flapper 140 may have a diameter which is the same as or larger than the central well 130 diameter. The larger sized diameter of the flapper 140 allows a sealing shelf between the flapper 140 and the cylindrical wall 132 and prevents the flapper 140 from being pushed through the sealing area by the force of the water on the flapper 140.

The cap 100 may be made of any suitable plastic (e.g., low density polyethylene) and may be manufactured using a conventional injection-molding technique. In one embodiment, all plastic components of the cap 100 are formed in a single injection molding step so as to form a single, unitary plastic structure. A secondary material may be used during the molding process to provide the flapper 140 with more memory characteristics to allow quicker sealing when the probe 18 is retracted from the central well 130. The secondary material may be for example, a rubber or flexible thermoplastic. The secondary material may allow the thickness of flapper 140 to be thinner than 20 mils to allow the flapper 140 to close more easily. An antimicrobial compound may be added to the materials for molding the cap and/or the flapper to prevent bacteria growth on the cap surfaces.

Figure 20:
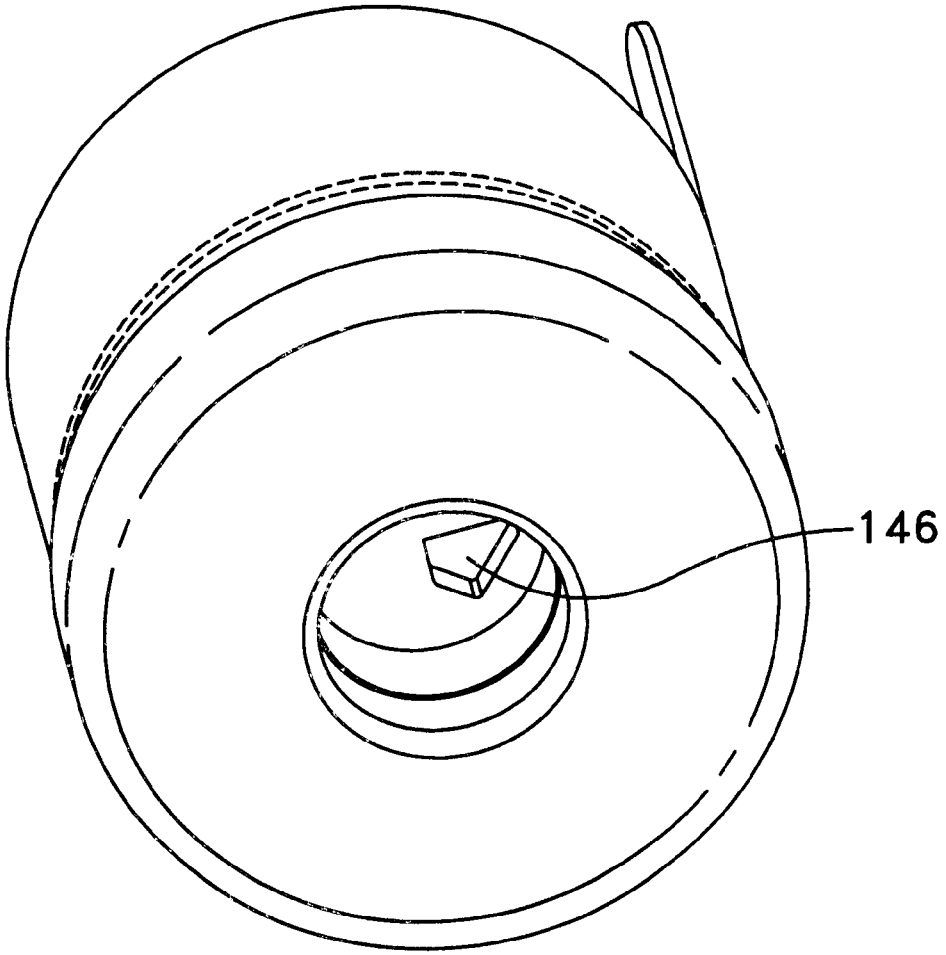
FIG. 20 is a perspective view of a bottle cap according to another embodiment of the present invention.

Yet another alternate embodiment is illustrated in FIGS. 13–19. In this embodiment, the flapper 140 preferably includes one or more protrusions 146*a,* 146*b* supported on an underside 148 of the flapper to improve separation of the flapper from the cylindrical wall 132. The protrusion is designed to be engaged by the tip of the blunt tip probe 18 in order to concentrate the force of the probe 18 to facilitate separation of the flapper 140 from the cylindrical wall 132 along the score line 142. In this manner, separation of the flapper 140 is readily achieved, which allows for more ample or increased tolerances during production of the flapper and score line 142. The protrusion 146 may preferably be supported adjacent the periphery of the flapper (or base prior to separation of the flapper), such that the protrusion remains attached to the flapper upon separation. The protrusion is most preferably disposed a distance from the center of the flapper, opposite the hinge formed by tabs 141 or bridge 144. By being positioned opposite the hinge and off center, the flapper may be readily separated around its perimeter while the hinge remains attached to the bottom surface of the central well. In the present embodiment, a pair of protrusions 146*a,* 146*b* are preferably provided. Each protrusion 146*a,* 146*b* preferably includes a base portion 148 supported on the underside of the flapper, a first inclined surface 150 and a second inclined surface 152 which meet in an engagement tip 154 for contact with the probe. The protrusions 146*a,* 146*b* may preferably be connected by a bridge 147 to provide additional support thereto. Alternately, a single protrusion 146 may be provided as shown in FIG. 20. The shape and size of the protrusion(s) may be varied, as would be known to those of skill in the art.

Use of the bottle cap 100 having a flapper 140 defined by a pre-formed score line 142 will now be described with reference to the figures.

Figure 1:
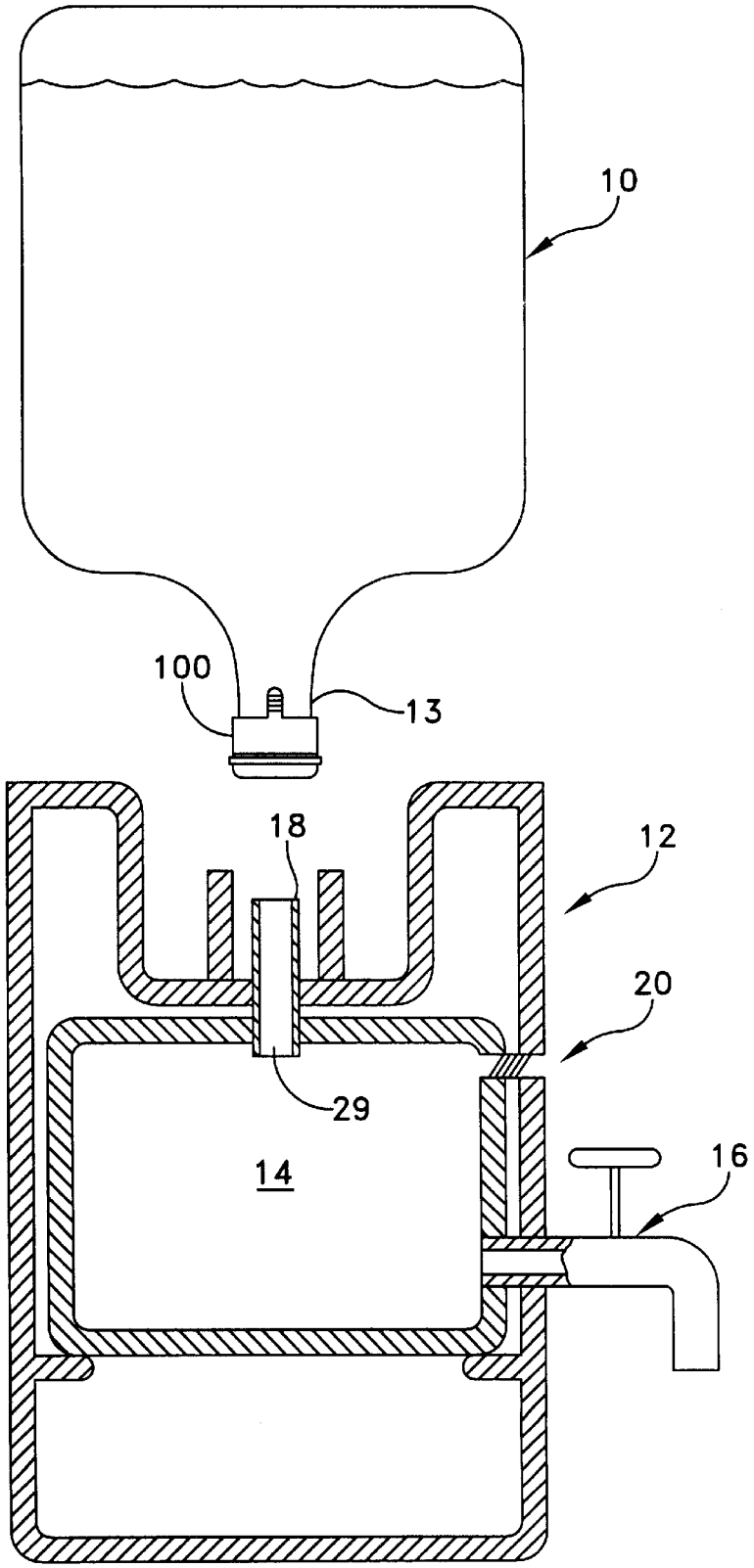
FIG. 1 is a cross-sectional view of an exemplary bottle and water dispenser for use with the bottle cap of the present invention.

FIGS. 5–7 and 16–18 illustrate the insertion of probe 18 into central well 130 of the cap 100 during use. Typically, but not always, this occurs by lowering water bottle 10 carrying a cap 100 onto a water dispenser 12 having a probe 18 (as shown in FIG. 1). However, for convenience in terms of description, this action will be described in terms of the probe 18 entering central well 130 and piercing cap 100, rather than in terms of the water bottle 10 moving toward the probe 18.

As shown in FIG. 5, the probe 18 may preferably be formed from a hollow tube having a blunt, rounded top surface 180. The top surface may be closed to prevent debris from falling through probe 18 into chamber 14 of dispenser 12 when a water bottle 10 is not in place on the dispenser 12. In this situation, at least one and preferably more than one aperture 182 may be formed through the wall of the hollow tube 29 forming probe 18 so that, upon insertion of the probe 18 into the water bottle 10, water may flow through the aperture(s) 182, down through the probe 18, and into the chamber 14 of the water dispenser 12. Although preferably utilized with a blunt tip probe, the cap disclosed herein may likewise be utilized with other style probes known in the art.

The probe 18 is inserted into the central well 130 until the top surface 180 comes into contact with the flapper 140. (see FIG. 6). At that point in time, the weight of the water will cause the water bottle to press down on the cap 100 to cause the probe 18 to push through the flapper 140 and separate the flapper 140 from the cylindrical wall 132 along the score line 142 (see FIG. 7). The bridge 144 is not severed in this process so that the flapper 140 remains attached via the bridge 144 to the cylindrical wall 132 defining the central well 130. Tabs 141 shown in FIGS. 4A and 10 may be used instead of the bridge 144, and both tabs 141 remain attached to the cylindrical wall 132 when the probe is inserted. The side views of bridge 144 and tabs 141 are substantially the same and therefore the side views of tabs 141 are not shown separately herein. A seal is formed between the probe 18 and the cylindrical wall 132 as discussed above.

Figure 16:
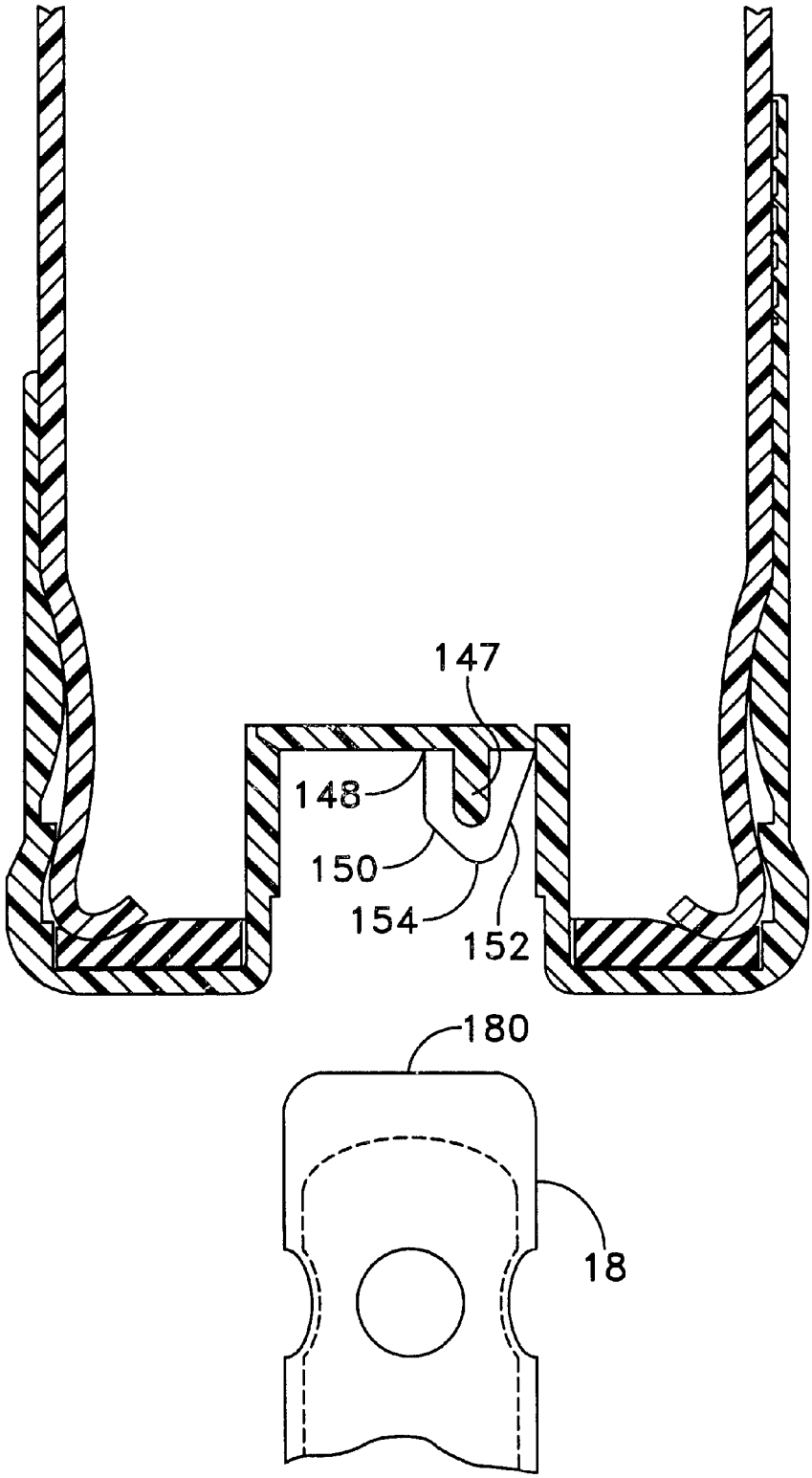
FIG. 16 is a cross-sectional view of the bottle cap of FIG. 13 taken along line 15—15 of FIG. 14 including a flapper protrusion, prior to insertion of a probe.
Figure 17:
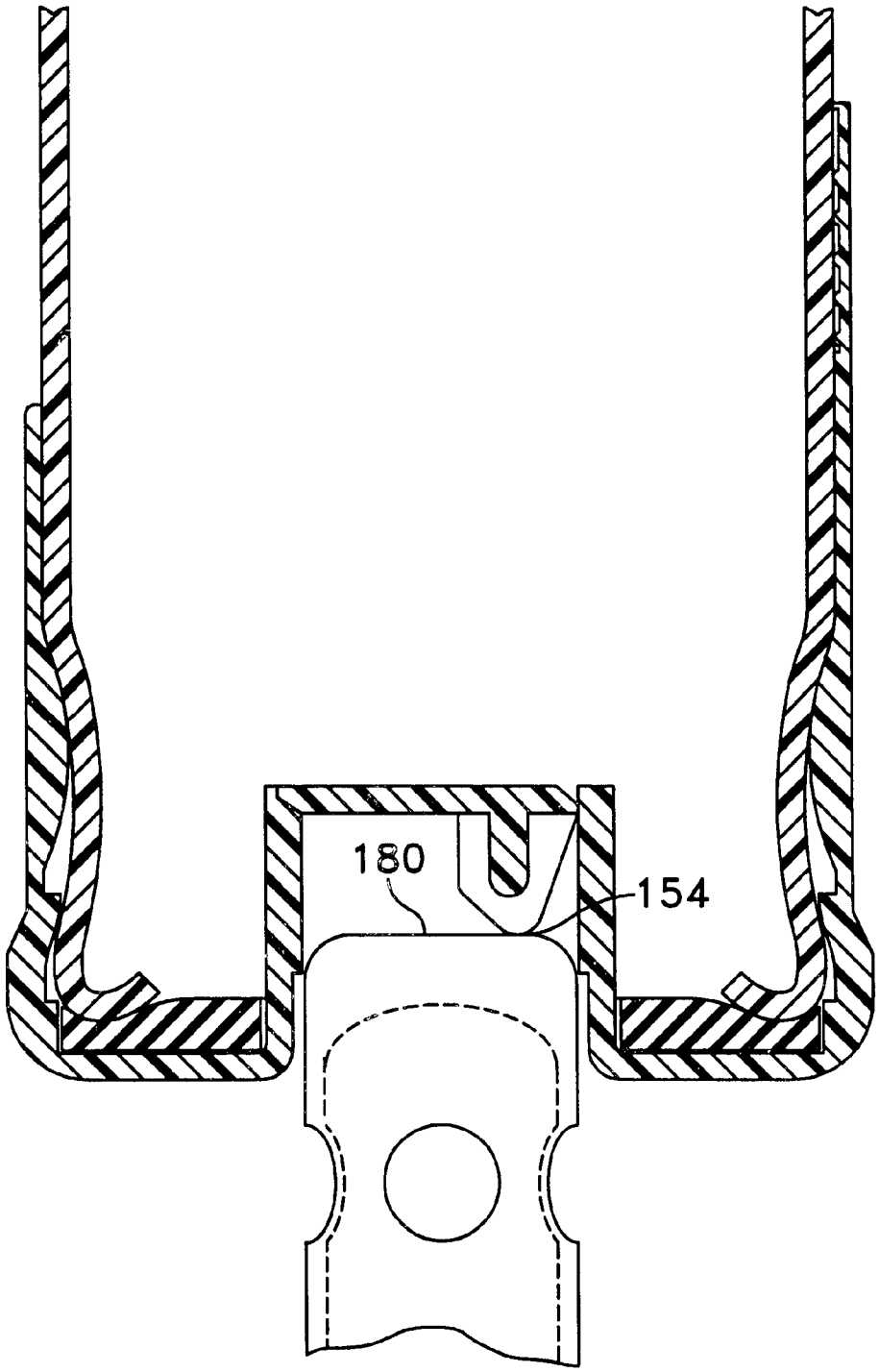
FIG. 17 is a cross-sectional view of the bottle cap of FIG. 13 taken along line 15—15 of FIG. 14 including a flapper protrusion, subsequent to insertion of the probe, but before the probe tears the flapper from the cylindrical sidewall along the score line.
Figure 18:
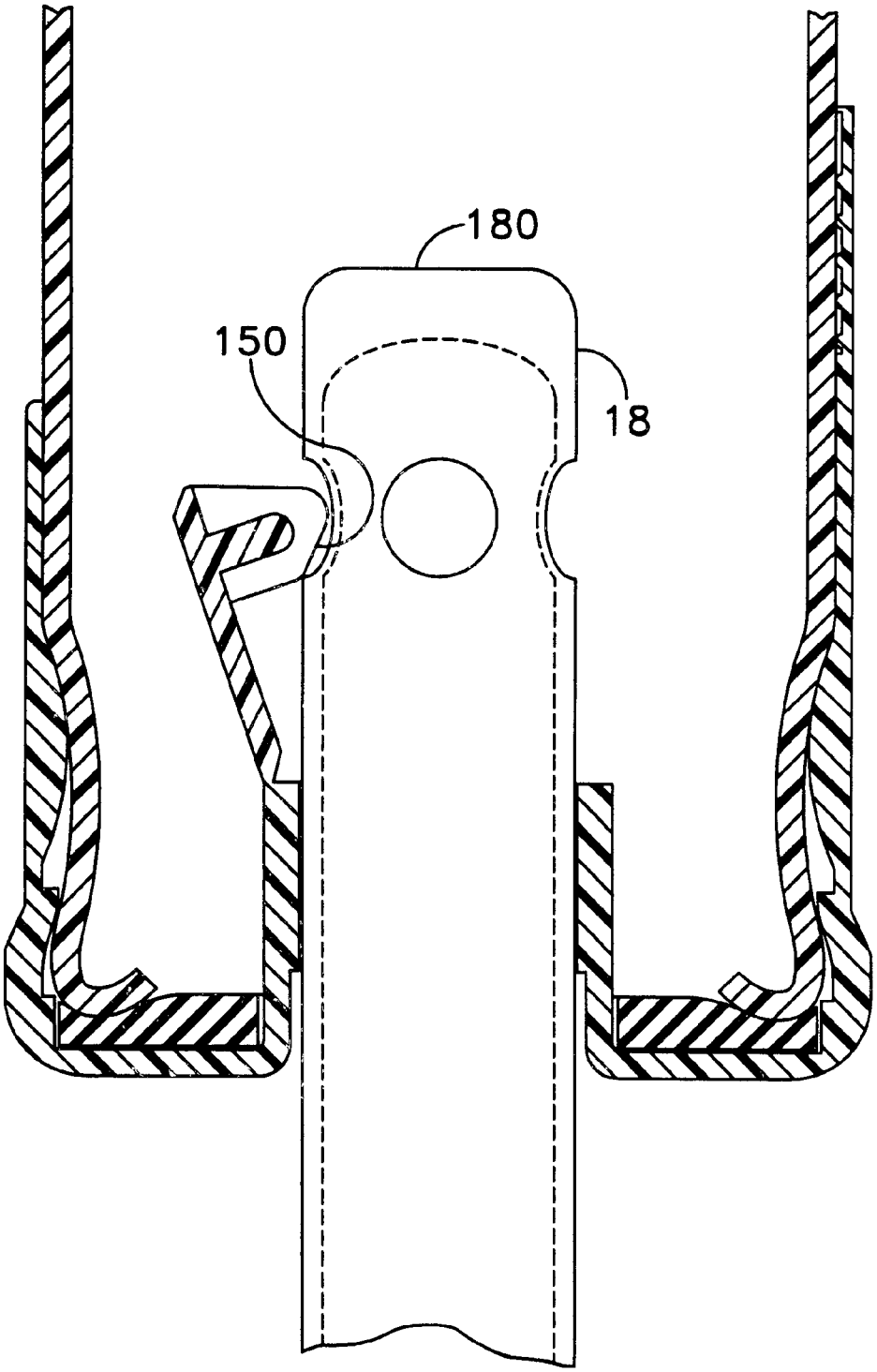
FIG. 18 is a cross-sectional view of the bottle cap of FIG. 13 taken along line 15—15 of FIG. 14 including a flapper protrusion, after the flapper has been separated from the cylindrical sidewall along the score line.
Figure 19:
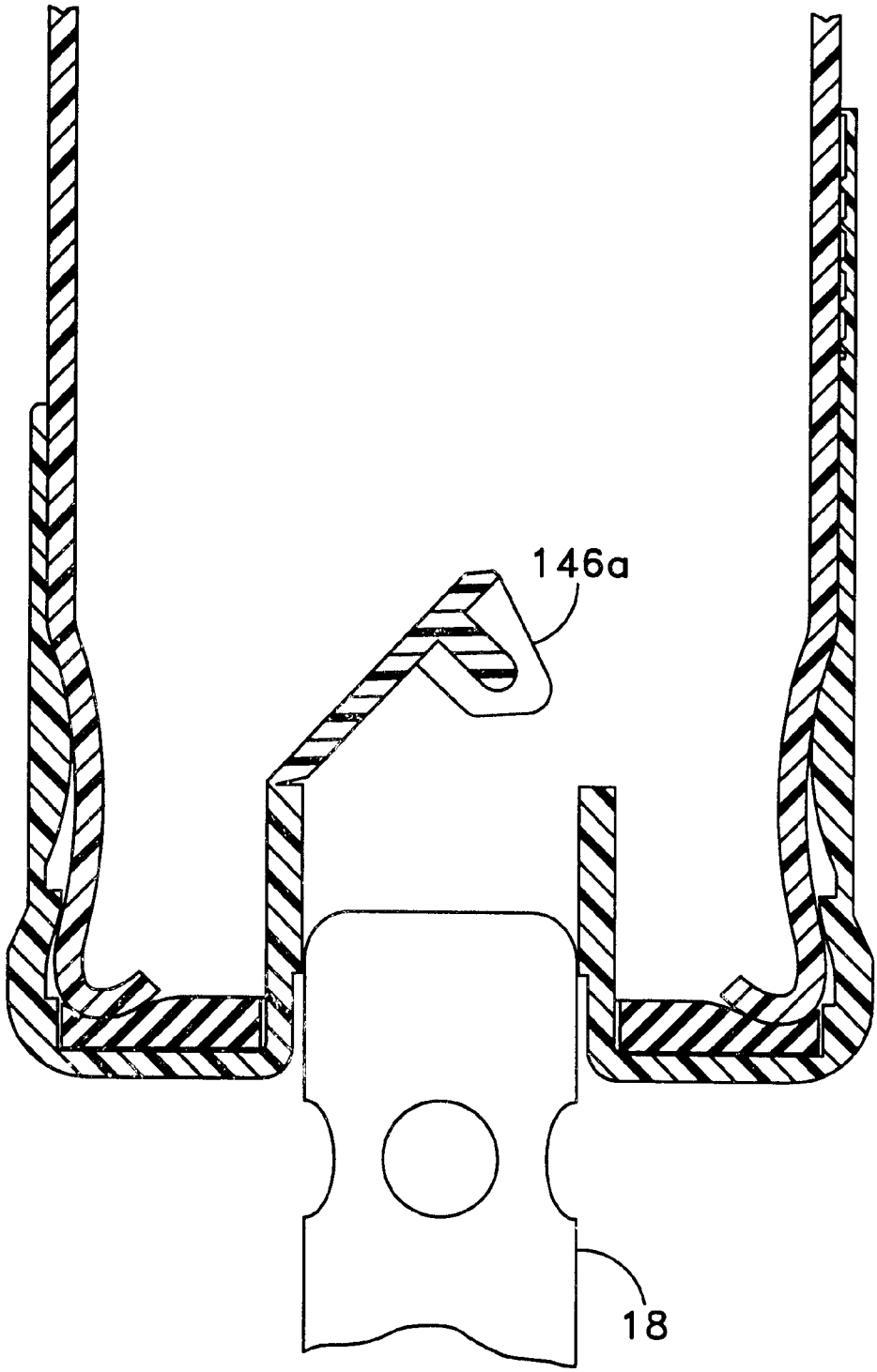
FIG. 19 is a cross-sectional view of the bottle cap of FIG. 13 taken along line 15—15 of FIG. 14 including a flapper protrusion, after the probe has been partially withdrawn from the bottle cap.

Alternatively, as shown in FIGS. 16–18, the blunt tip 180 of the probe 18 contacts the one or more protrusions 146*a, b* supported on the underside 148 of the base 143. The blunt tip preferably initially encounters the engagement tip 154 of the protrusion, which is preferably rounded. As the tip of the probe pushes on the engagement tip 154, the force from the probe is sufficient to break the flapper 140 from engagement with the cylindrical wall 132 along the score line 142. As the probe enters the neck of the bottle through the cap, a portion of the tip of the probe may ride along the inclined or angled surface 150, and a portion may contact the underside of the base. Once the probe is fully inserted, as seal is likewise formed between the probe 18 and the cylindrical wall 132 as discussed above.

FIG. 9 illustrates the flapper 140 in both the initial position, before insertion of the probe 18, and after the flapper 140 has been separated from the cylindrical wall 132 along the score line 142. The dashed circle represents the flapper 140 after separation from the cylindrical wall 132. In this alternate embodiment, the bridge 144 is formed on the edge of the cylindrical wall 132 closest to the viewer. In another embodiment, instead of moving vertically, the flapper 140 may slide to the side of the probe 18 during the insertion of the probe 18.

Figure 8:
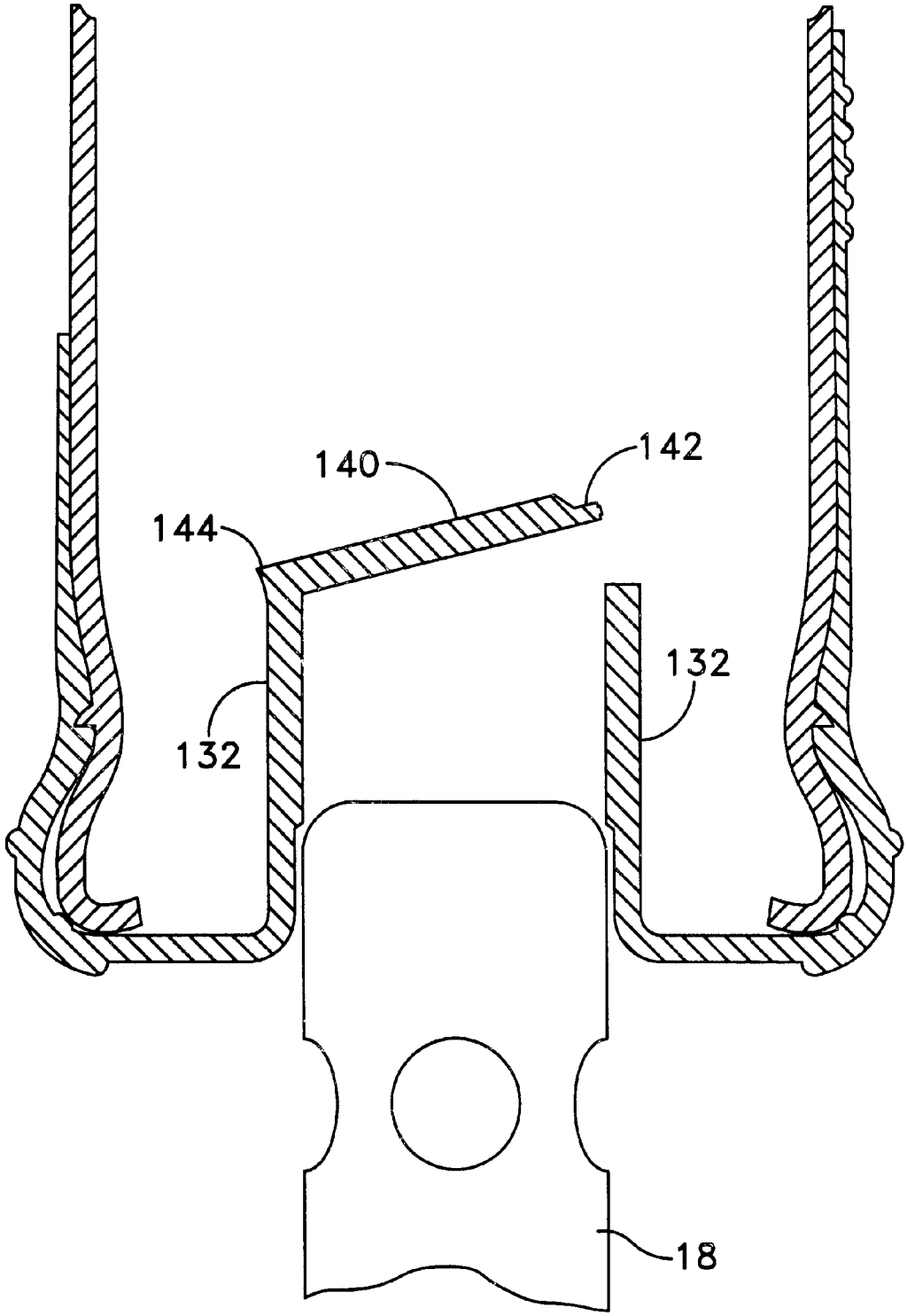
FIG. 8 is a cross-sectional view of the bottle cap of FIG. 2 taken along line 3—3 of FIG. 2 and along line 5—5 of FIGS. 4A, 4B after the probe has been partially withdrawn from the bottle cap.

When the probe 18 is retracted, as illustrated in FIG. 8 (and FIG. 19), the bridge 144 causes the flapper to return toward its initial sealed position. Tabs 141 (FIGS. 4A, 10) have a similar effect on the flapper 140 when the probe 18 is retracted. The bridge 144 (and tabs 141) thus exhibits at least some shape memory tending to return the flapper toward its initial position. By returning the flapper 140 toward its initial sealed position, it is possible to minimize the amount of water that is spilled when the water bottle 10 is removed from the water cooler 12.

Having thus described several particular embodiments of the invention, there is alternations, modifications and improvements that will readily occur to those skilled in the art. Such alternations, modifications, and improvements as are made obvious by this disclosure are intended to be part of this disclosure, though not expressly stated herein, and are intended to be within the spirit and scope of the invention. For example, it should be understood that the disclosed dimensions may vary and are only approximations of a preferred embodiment, and that any suitable material may be utilized for cap. Accordingly, the foregoing description is by way of example only and is not intended to be limiting. The invention is limited only as defined in the following claims and equivalence thereto.

What is claimed is:

1. A hygienic bottle cap for use with a fluid container having a neck, and a dispenser including a probe, the cap comprising;

a skirt and a crown portion constructed and arranged to receive the neck of the container therein such that an outer surface of the neck of the container is sealed by at least a portion of the inner surface of the crown portion;

a cylindrical wall having an upper portion and a lower portion and forming a central well in the crown portion, the central well defining an opening in communication with an interior of the bottle and being sealed by a base in a closed position;

a pre-formed score line disposed partially around the perimeter of the base to define a flapper, a portion of the flapper remaining attached to the cylindrical wall upon insertion of the probe;

a protrusion supported on an underside of the flapper, adjacent the perimeter of the flapper, the protrusion including a base portion supported on the underside of the flapper, at least one first inclined surface and an engagement tip constructed and engaged to engage a blunt tip of the probe of the dispenser; and wherein upon a probe engaging the protrusion, a portion of the flapper is separated from the cylindrical wall along the pre-formed score line in order to enter the container, a portion of the flapper remaining attached to the cylindrical wall so as to form a hinge, the hinge being disposed opposite the protrusion.

2. The bottle cap of claim 1, wherein the engagement tip is rounded.

3. The bottle cap of claim 1, wherein the protrusion includes a pair of protrusions.

4. The bottle cap of claim 3, wherein the pair of protrusions are connected by a bridge.

5. The bottle cap of claim 1, wherein the protrusion is spaced from a center of the flapper.

6. The hygienic bottle cap of claim 1, wherein the flapper substantially returns to an initial sealed position after the probe is retracted from the container.

7. The hygienic bottle cap of claim 1, wherein the cylindrical wall extends beyond the flapper.

8. The hygienic bottle cap of claim 1, wherein the flapper forms the entire base of the central well, such that the flapper forms a sealing shelf with the cylindrical wall.

9. A liquid dispensing system, including a fluid container comprising:

a hygienic bottle cap constructed and arranged to fit on the container, the cap having a central well, a flapper formed on a portion of a bottom of the central well, the flapper being attached to a cylindrical wall forming the central well and being defined by a pre-formed score line disposed partially around the perimeter of the flapper, and a protrusion supported on an underside of the flapper adjacent the perimeter of the flapper, the protrusion including a base portion supported on the underside of the flapper, at least one first inclined surface and an engagement tip constructed and engaged to engage a blunt tip of the probe of the dispenser;

a blunt tip probe connected to the liquid dispensing system, wherein as the probe contacts the protrusion the probe separates the flapper from a portion of the cylindrical wall along the pre-formed score line so as to allow liquid to flow from the container to a valve in the liquid dispensing system, a portion of the flapper remaining attached to the cylindrical wall.

10. The hygienic bottle cap of claim 9, wherein the protrusion is disposed opposite the portion of the flapper remaining attached to the cylindrical wall.

11. The bottle cap of claim 9, wherein the engagement tip is rounded.

12. The bottle cap of claim 9, wherein the protrusion includes a pair of protrusions.

13. The bottle cap of claim 12, wherein the pair of protrusions are connected by a bridge.

14. The bottle cap of claim 9, wherein the protrusion is spaced from a center of the flapper.

15. The hygienic bottle cap of claim 9, wherein the flapper substantially returns to an initial sealed position after the probe is retracted from the container.

16. The hygienic bottle cap of claim 9, wherein the flapper forms the entire base of the central well, such that the flapper forms a sealing shelf with the cylindrical wall.

17. A hygienic bottle cap for use with a fluid container having a neck, and a dispenser including a probe, the cap comprising;

a skirt and a crown portion constructed and arranged to receive the neck of the container therein such that an outer surface of the neck of the container is sealed by at least a portion of the inner surface of the crown portion;

a cylindrical wall having an upper portion and a lower portion and forming a central well in the crown portion, the central well defining an opening in communication with an interior of the bottle and being sealed by a base in a closed position;

a pre-formed score line disposed partially around the perimeter of the base to define a flapper, a portion of the flapper remaining attached to the cylindrical wall upon insertion of the probe;

a pair of protrusion supported on an underside of the flapper, adjacent the perimeter of the flapper; and wherein upon a probe engaging the protrusion, a portion of the flapper is separated from the cylindrical wall along the pre-formed score line in order to enter the container, a portion of the flapper remaining attached to the cylindrical wall so as to form a hinge, the hinge being disposed opposite the protrusion.

* * * * *